US007637774B1

(12) United States Patent
Vaccaro

(10) Patent No.: US 7,637,774 B1
(45) Date of Patent: Dec. 29, 2009

(54) METHOD FOR MAKING COAXIAL CABLE CONNECTOR COMPONENTS FOR MULTIPLE CONFIGURATIONS AND RELATED DEVICES

(75) Inventor: Ronald A. Vaccaro, Hickory, NC (US)

(73) Assignee: Commscope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/201,682

(22) Filed: Aug. 29, 2008

(51) Int. Cl.
*H01R 9/05* (2006.01)

(52) U.S. Cl. ..... 439/578; 29/828

(58) Field of Classification Search ..... 439/578, 439/583–585; 29/828
See application file for complete search history.

(56) References Cited

U.S. PATENT DOCUMENTS

| | | | | |
|---|---|---|---|---|
| 4,046,451 | A | 9/1977 | Juds et al. | 339/177 |
| 5,637,830 | A | 6/1997 | Hashizawa et al. | 174/84 |
| 5,795,188 | A * | 8/1998 | Harwath | 439/583 |
| 5,802,710 | A | 9/1998 | Bufanda et al. | 29/828 |
| 5,993,254 | A | 11/1999 | Pitschi et al. | 439/584 |
| 6,024,609 | A | 2/2000 | Kooiman et al. | 439/675 |
| 6,217,380 | B1 | 4/2001 | Nelson et al. | 439/578 |
| 6,386,915 | B1 | 5/2002 | Nelson | 439/584 |
| 6,396,367 | B1 | 5/2002 | Rosenberger | 333/260 |
| 6,607,398 | B2 | 8/2003 | Henningsen | 439/578 |
| 6,955,562 | B1 | 10/2005 | Henningsen | 439/578 |
| 7,011,546 | B2 | 3/2006 | Vaccaro | 439/580 |
| 7,077,700 | B2 | 7/2006 | Henningsen | 439/583 |
| 7,104,839 | B2 | 9/2006 | Henningsen | 439/578 |
| 2005/0118865 | A1 | 6/2005 | Henningsen | 439/578 |
| 2006/0148315 | A1 | 7/2006 | Andreescu | 439/583 |
| 2007/0037446 | A1 | 2/2007 | Khemakhem et al. | 439/578 |

* cited by examiner

*Primary Examiner*—Tho D Ta
(74) *Attorney, Agent, or Firm*—Allen, Dyer, Doppelt, Milbrath & Gilchrist, P.A.

(57) ABSTRACT

A method for making coaxial cable connector components for assembly into either first or second different connector configurations may include forming center contacts for the first connector configuration and forming common connector components for either the first or second connector configuration. The common connector components may include common connector housings; common back nuts, each for clamping a coaxial cable outer conductor in cooperation with a respective common connector housing; and common forward dielectric bodies, each having a passageway therethrough. The common forward dielectric body is for supporting a respective center contact for the first connector configuration, and for alternatively supporting a respective forward portion of a coaxial cable inner conductor for the second configuration. The common forward dielectric bodies may provide impedance matching with a coaxial cable for both the first and second connector configurations.

30 Claims, 6 Drawing Sheets

METHOD FOR MAKING COAXIAL CABLE CONNECTOR COMPONENTS FOR MULTIPLE CONFIGURATIONS AND RELATED DEVICES

FIELD OF THE INVENTION

The present invention relates to the field of connectors, and, more particularly, to coaxial cable connectors and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter cable extending between the equipment shelter and the top of the antenna tower to thereby reduce signal losses. For example, CommScope, Inc. of Hickory, N.C. and the assignee of the present invention offers its CellReach® coaxial cable for such applications.

Each end of the main coaxial cable may be coupled to a smaller diameter, and relatively short, coaxial cable jumper assembly. The coaxial cable jumper assembly includes a length of coaxial cable with connectors attached to the opposing ends. The cable of the jumper cable assembly is typically of a smaller diameter than the main coaxial cable to provide a smaller cross-section, greater flexibility and facilitate routing at the equipment shelter, and also at the top of the antenna tower, for example. Connectors are typically coupled to each end of the jumper coaxial cable to form the coaxial cable jumper assembly.

The connectors for the jumper cable assembly can be installed onto the ends of the coaxial cable at the cable manufacturing plant and/or in the field. Connectors are available in two main categories—mechanical-type connectors, which are configured for mechanical installation onto the end of the jumper coaxial cable, and solder-type connectors, which are configured to be coupled by soldering. Unfortunately, the mechanical-type connector may be relatively complicated, include many parts, and, therefore, may be relatively expensive. Solder-type connectors may be less expensive because of fewer parts. For example, U.S. Pat. No. 5,802,710 to Bufanda et al. discloses a solder-type connector which uses a solder preform wrapped around an annularly corrugated outer conductor of the coaxial cable. The connector body is placed over the solder preform and then heated to solder the connector to the end of the cable.

A typical mechanical-type coaxial cable connector for a coaxial cable includes a tubular housing or body to make an electrical connection to the cable outer conductor, and a center contact to make an electrical connection to the inner conductor of the coaxial cable. The center contact may include a tubular rearward end to receive the inner conductor of the coaxial cable. An insulator assembly supports the center contact within the housing.

A typical connector may also include a gripping member or ferrule that is positioned onto the end of the outer conductor and adjacent the outer insulating jacket portion of the coaxial cable. The ferrule is axially advanced into the housing as a back nut is tightened onto the rearward end of the housing. One or more O-rings may be provided to environmentally seal the connector to prevent the ingress of water, for example, into the connector.

Representative patents directed to coaxial cable connectors include U.S. Pat. No. 6,396,367 B1 to Rosenberger; U.S. Pat. No. 6,024,609 to Kooiman et al.; U.S. Pat. No. 6,607,398 B2 to Henningsen; and U.S. Pat. No. 6,217,380 B1 to Nelson et al. The entire contents of each of these patents are incorporated herein by reference.

One important consideration in connector manufacturing is reducing the cost of the connectors. Different connector configurations typically have different components, and the need for many different components may increase the manufacturing cost.

SUMMARY OF THE INVENTION

In view of the foregoing background, it is therefore an object of the present invention to provide a method for making coaxial cable connector components that are readily manufactured and assembled into different connector configurations, and cost effective.

This and other objects, features, and advantages in accordance with the present invention are provided by a method for making coaxial cable connector components for assembly into either first or second different connector configurations, such as either a field installable or factory installable configuration. The method may include forming a plurality of center contacts for the first connector configuration, and forming a plurality of common connector components for either the first or second connector configuration. The common connector components may include a plurality of common connector housings, and a plurality of common back nuts, each for clamping an outer conductor of a coaxial cable in cooperation with a respective common connector housing. The common connector components may also include a plurality of common forward dielectric bodies, each having a passageway therethrough, and for supporting a respective center contact for the first connector configuration, and for alternatively supporting a respective forward portion of an inner conductor of a coaxial cable for the second configuration. The common forward dielectric bodies may provide impedance matching with a coaxial cable for both the first and second connector configurations, for example. Accordingly, the method provides for making coaxial cable connector components that are readily manufactured and assembled into different connector configurations.

Forming each common forward dielectric body may include forming a cylindrical dielectric body having a sidewall with a plurality of hollow cavities to set an impedance. Each of the hollow cavities may extend only partway into the sidewall, and each of the hollow cavities may have a cylindrical shape, for example. Each of the common forward dielectric bodies may also include a longitudinal axis, and each of the hollow cavities may comprise an elongate hollow cavity extending generally parallel with the longitudinal axis of each common forward dielectric body. The hollow cavities may be equally spaced about the longitudinal axis of each common forward dielectric body, for example.

The method may also include forming a plurality of rearward dielectric bodies for the first connector configuration. Each of these may have a passageway therethrough for supporting a respective rearward portion of the inner conductor of the coaxial cable.

The first connector configuration may be a field installable connector configuration, and the second connector configuration may be a factory installable connector configuration, for example. The method may further include packaging the connector components in respective first and second packages for assembly into the first and second connector configurations.

Forming each common connector housing may further include forming a monolithic tubular metallic body having threads on a rearward surface thereof, for example. Each common back nut may be formed as a monolithic tubular body having threads on a portion thereof. Additionally, the method may include forming the common connector components to further include a plurality of common sealing rings.

Another aspect relates to a method for field installation of a coaxial cable connector onto a coaxial cable end. The method may include providing a center contact, and providing a set of common connector components for either a field installable connector configuration, or alternatively for a factory installable connector configuration, for example. The set of common connector components may include a common connector housing, a common back nut for clamping an outer conductor of the coaxial cable in cooperation with the common connector housing, and a common forward dielectric body. The common forward dielectric body may have a passageway therethrough and may be for supporting the center contact for the field installable configuration, and alternatively supporting a respective forward portion of the inner conductor of the coaxial cable for the factory installable configuration. The common forward dielectric body may provide impedance matching with the coaxial cable for both field installable and factory installable connector configurations. The method further includes assembling the set of common connector components and the center contact on the end of the coaxial cable.

Yet another aspect relates to a method for factory installation of a coaxial cable connector onto a coaxial cable end. The method may include providing a set of common connector components for either a field installable connector configuration, or alternatively for a factory installable connector configuration. The set of common connector components may include a common connector housing, a common back nut for clamping an outer conductor of the coaxial cable in cooperation with the common connector housing, and a common forward dielectric body. The common forward dielectric body may have a passageway therethrough and may be for supporting a respective forward portion of the inner conductor of the coaxial cable for the factory installable configuration, and for alternatively supporting a center contact for the field installable configuration. The common forward dielectric body may provide impedance matching with the coaxial cable for both field installable and factory installable connector configurations. The method may further include assembling the set of common connector components to the end of the coaxial cable.

Still further, another aspect relates to a coaxial cable connector assembly including a coaxial cable end comprising an inner conductor, an outer conductor, and a dielectric layer therebetween. The coaxial cable connector assembly may include a housing and a forward dielectric body carried by the housing. The forward dielectric body may have a cylindrical shape and may include a sidewall defining a passageway therethrough receiving the inner conductor, for example. The sidewall may include at least one hollow cavity therein to set an impedance.

The coaxial cable connector assembly may also include a back nut for clamping the outer conductor in cooperation with the housing. The dielectric layer may have at least one impedance matching circumferential notch therein for providing impedance matching with the coaxial cable end.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
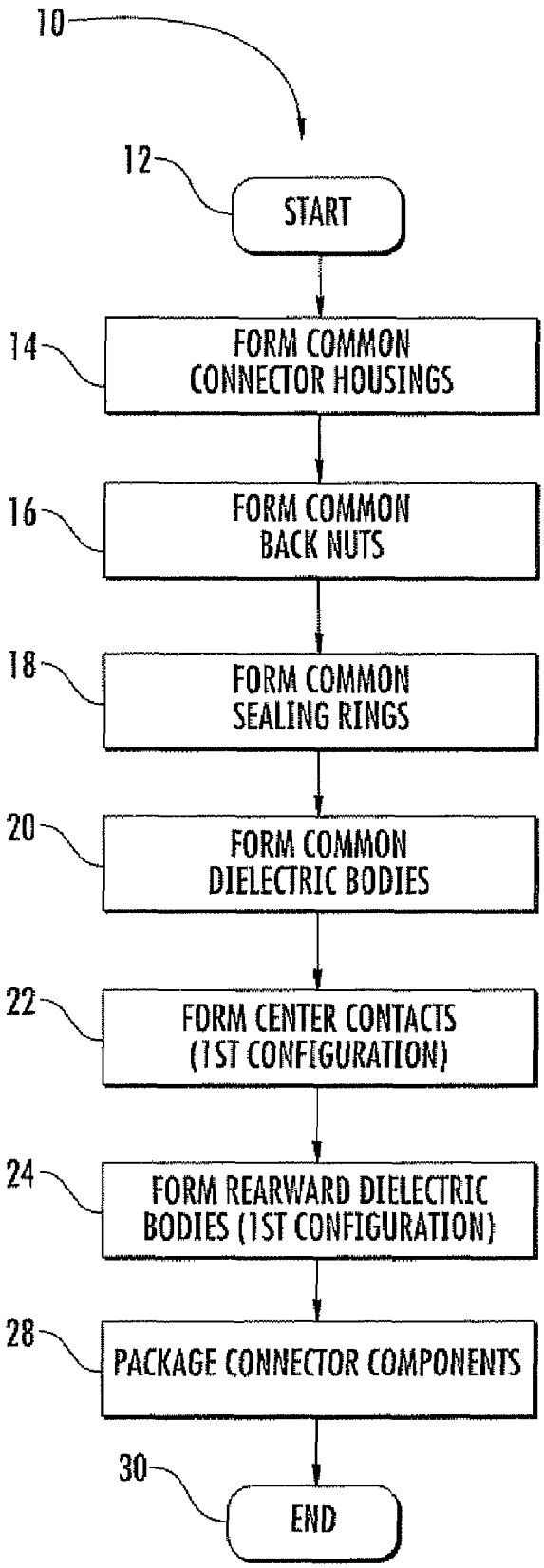
FIG. 1 is a flow chart illustrating a method for making coaxial cable connector components in accordance with the present invention.

Referring now to FIGS. 1-4, a method for making coaxial cable connector components for assembly into either a first connector configuration 100 (FIG. 2) or second connector configuration 100' (FIG. 3) is described with reference to the flowchart 10 (FIG. 1). More particularly, the method after the start (Block 12) includes forming a plurality of common connector components for either the first or second connector configurations 100, 100'.

At Block 14 the method includes forming common connector housings 101, each comprising a monolithic tubular metallic body having threads 115 on a rearward surface. The forming of common connector components also includes at Block 16 forming a plurality of common back nuts 116, each for clamping an outer conductor 112 of the coaxial cable 125 in cooperation with a respective common connector housing 101. Each common back nut 116 may be formed to include a monolithic tubular body having threads 115 on a portion thereof. Rearward threads 115*a* engage the coaxial cable jacket 113, and forward threads 115*b* mate with corresponding threads on the common connector housing 101. Optional sealing rings 127 may also be formed (Block 18) to provide a seal to respective forward and rearward interfaces adjacent the back nut 116 as well as to a forward interface adjacent a forward surface of the common connector housing 101 and to prevent moisture ingress, as will be appreciated by those skilled in the art.

The forming of common connector components also includes forming a plurality of common forward dielectric bodies 102 (Block 20). Each common forward dielectric body 102 also supports a respective center contact 108 for the first connector configuration 100.

Alternatively, each common forward dielectric body 102 supports a forward portion of the inner conductor 106 of the coaxial cable 125 in the second configuration 100'. As perhaps best shown in FIG. 4, each common forward dielectric body 102 is formed as a cylindrical dielectric body with a passage 136 at a center thereof. The cylindrical dielectric body 102 includes a sidewall 137. Forming the common dielectric body 102 also includes forming hollow cavities 134*a*-134*d* in the sidewall 137. The hollow cavities 134*a*-134*d* extend only partway into the sidewall and illustratively have a cylindrical shape. The hollow cavities 134*a*-134*d* advantageously provide impedance matching of the connector with the coaxial cable 125.

Each hollow cavity 134*a*-134*d* illustratively is an elongate hollow cavity that generally extends parallel with the longitudinal axis. The hollow cavities 134*a*-134*d* are equally angularly spaced about the longitudinal axis of each common forward dielectric body 102. Other configurations are also useable as would be readily understood by those skilled in the art.

Figure 2:
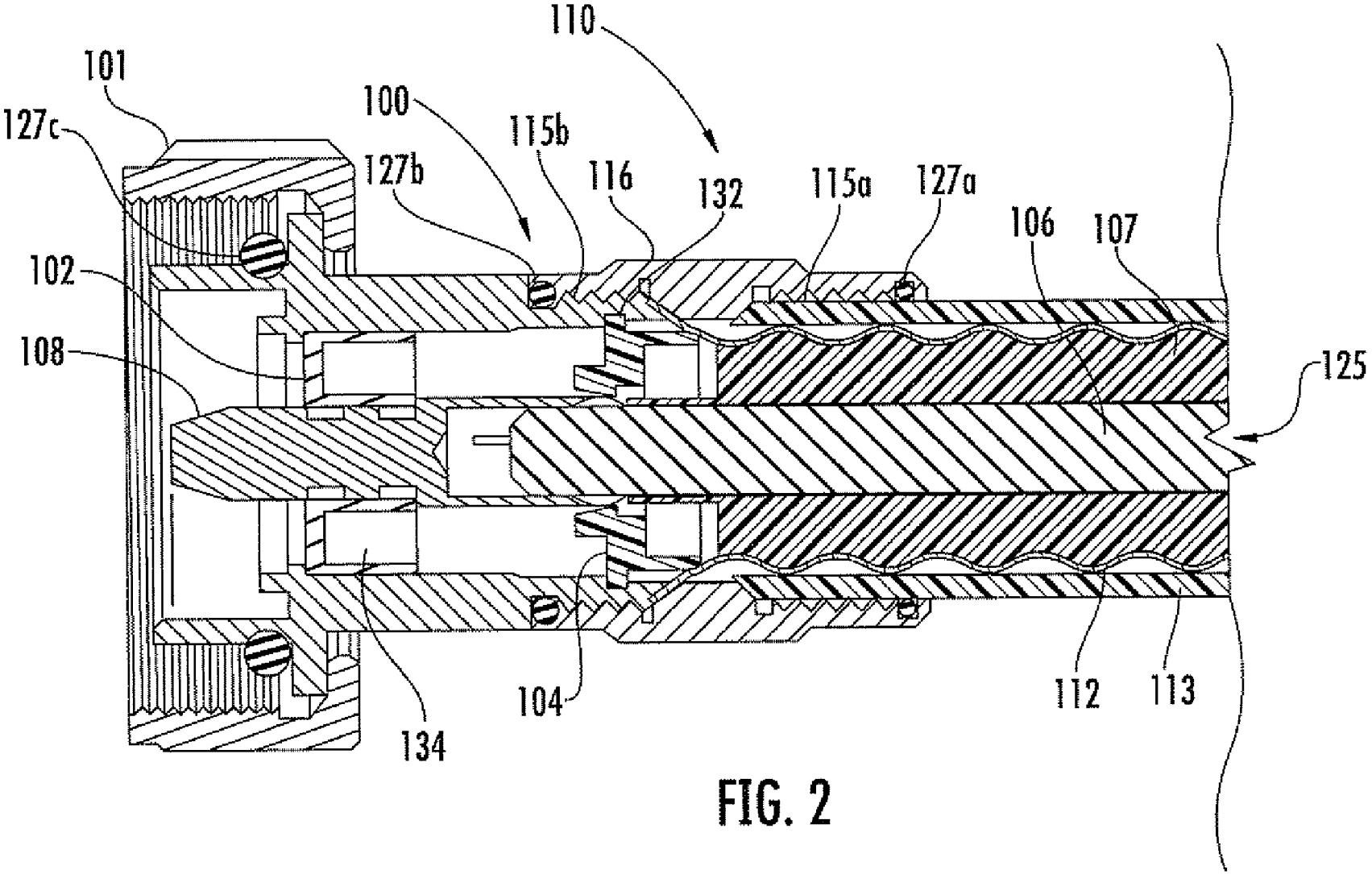
FIG. 2 is a longitudinal cross-sectional view of a portion of a coaxial cable connector in a field installable connector configuration assembled from the components manufactured as in the flow chart of FIG. 1

For the first configuration 100, that is the field installable connector configuration, as shown in FIG. 2, the method further includes forming a plurality of center contacts 108 at Block 22, each for being supported by a respective common forward dielectric body 102. The center contact 108 may be the most costly component in the connector. Advantageously, however, because of economies of scale, the cost of all components may be significantly reduced by the use of common connector components, as described herein.

Also, the method steps relating to the first configuration include forming a plurality of rearward dielectric bodies 104 (Block 24), each having a passageway therethrough for supporting a respective rearward portion of the inner conductor 106 of the coaxial cable 125.

Figure 3:
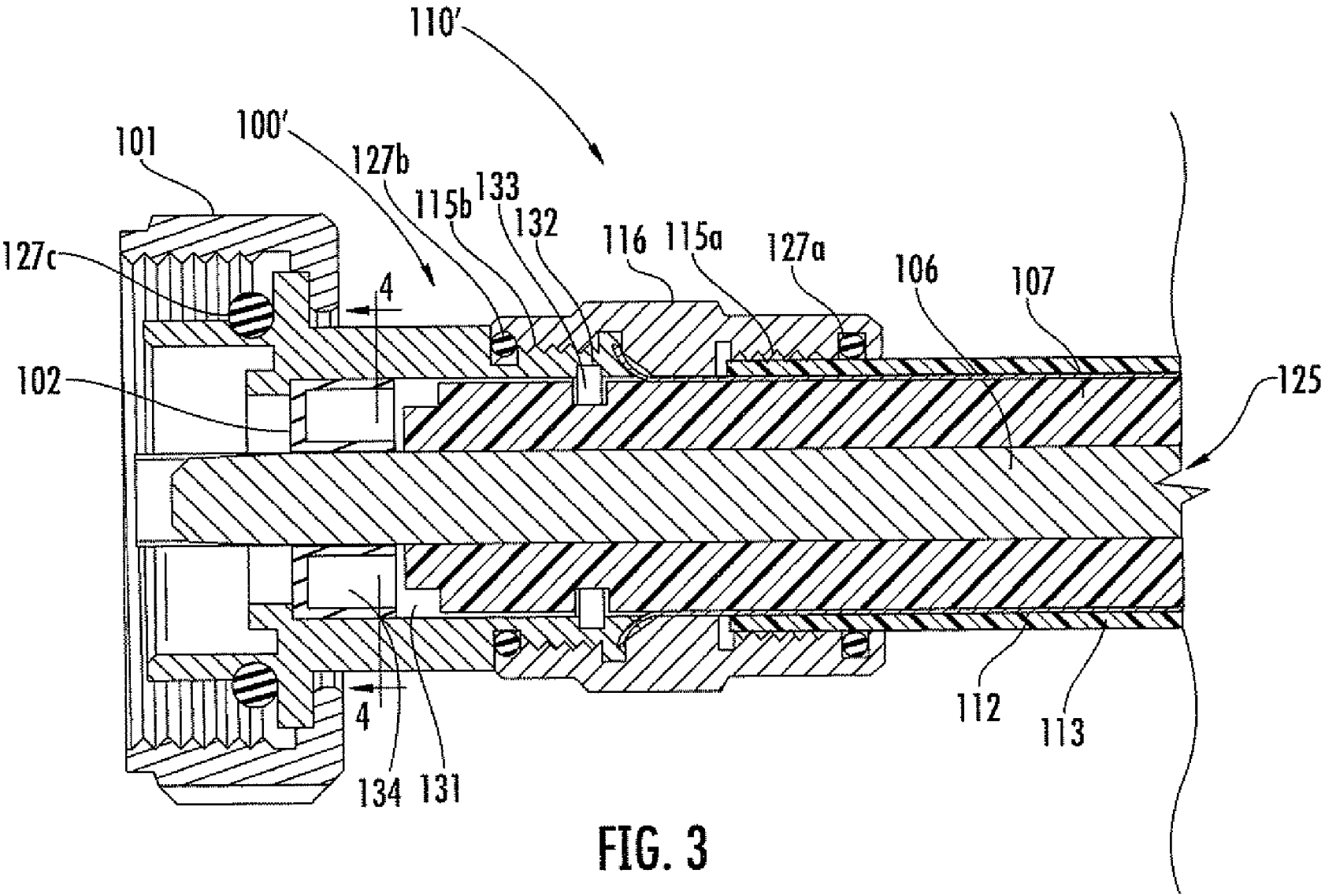
FIG. 3 is a longitudinal cross-sectional view of a portion of a coaxial cable connector in a factory installable connector configuration assembled from the components manufactured as in the flow chart of FIG. 1.
Figure 4:
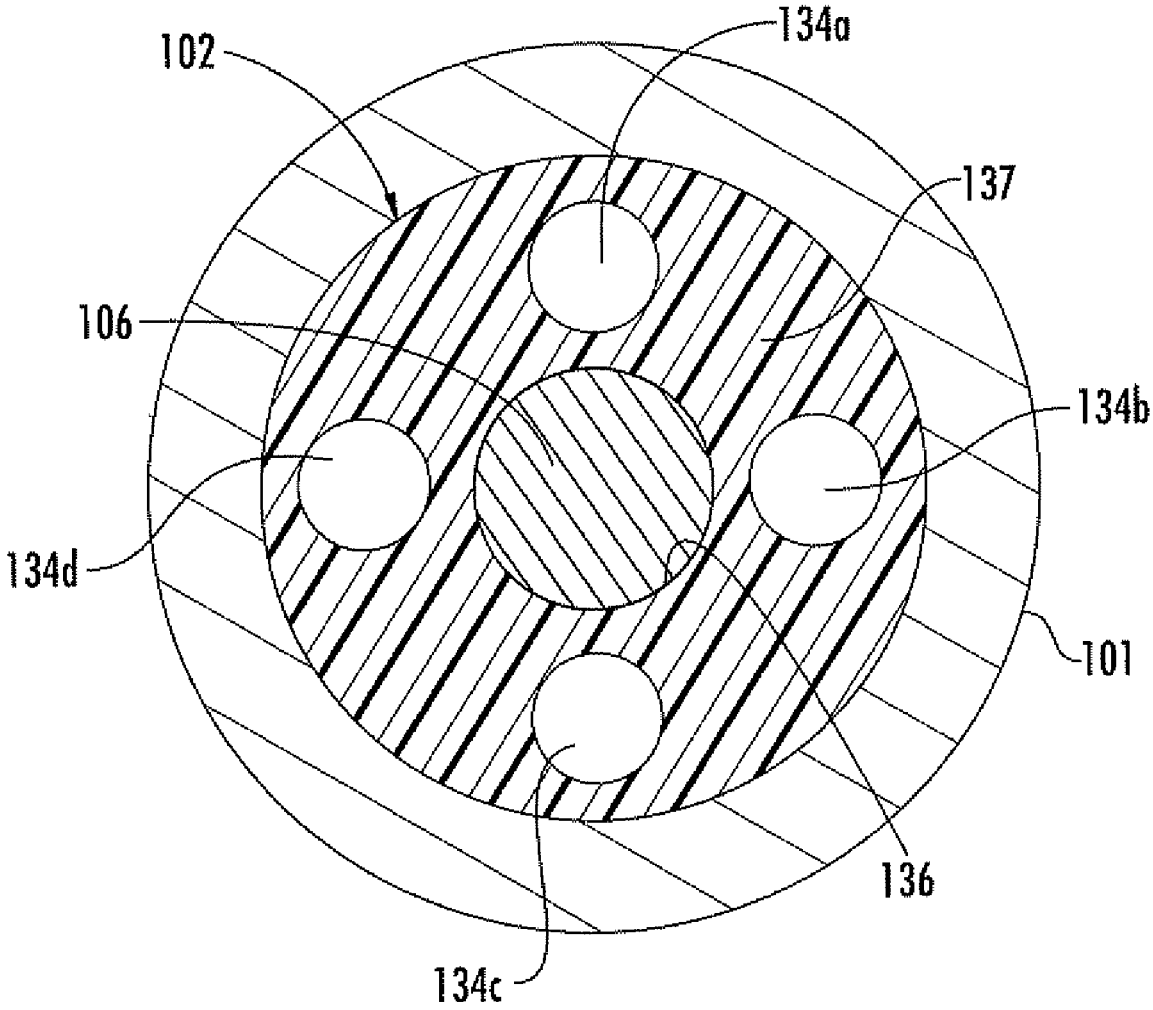
FIG. 4 is a cross-sectional view taken along line 4-4 of FIG. 3.

Illustratively, for the second configuration, that is, the factory installable connector configuration 100' as shown in FIG. 3, there is no center contact 108, as was seen in FIG. 2, as the inner conductor 106 is used without a center contact. Not using a center contact 108 saves cost, although it may mean that the connector installation is best done in a more controlled factory setting, rather than in the field by a technician using basic hand tools. In particular, passive intermodulation (PIN), a problem that may affect many connectors, is decreased, as will be appreciated by those skilled in the art. Additionally, the center conductor 106 may be desirably cut longer or tapered to simulate a ramp to ease mating. The diameter of a forward portion of the center contact 108 is illustratively the same as the diameter of the inner conductor 106. A rearward portion of the center contact 108 is slightly enlarged to receive the inner conductor 106 therein. This permits the common forward dielectric body 102 to have a central passageway 136 sized to accommodate either the center contact 108 or the inner conductor 106. At Block 28 the connector components are optionally packaged into respective first and second packages for storage, shipping and subsequent assembly into the first and second connector configurations before stopping (Block 30).

Referring more specifically to FIG. 3, a coaxial cable connector assembly 110' is described that includes a coaxial cable end 125 comprising an inner conductor 106, an outer conductor 112, and a dielectric layer 107 therebetween. A jacket 113 surrounds the outer conductor 112.

The coaxial cable connector 100' includes the same common components as described above except for the center contact 108. In addition, the coaxial cable connector assembly 110' also includes an impedance matching circumferential notch 131 positioned at an end of the dielectric layer 107 of the coaxial cable 125. A second impedance matching circumferential notch 133 is also included in the dielectric layer 107 and is illustratively positioned adjacent the inner circumferential notch 132 in the common connector housing 101. The second circumferential notch is illustratively longitudinally spaced from the first circumferential notch 131. The common connector housing inner circumferential notch 132 is also illustrated in FIG. 2, the field installable connector configuration 100, for receiving a portion of the rearward dielectric body 104 therein to secure the dielectric body.

Additional impedance matching circumferential notches 131, 133 may be included in the dielectric layer 107, for example. Additionally, the impedance matching circumferential notches 131, 133 may be positioned in different locations on the dielectric layer 107 to provide impedance matching, and typically the circumferential notches will be less than half of a thickness of the dielectric layer, as will be appreciated by those skilled in the art. The impedance matching notches 131, 133 advantageously cooperates with the common forward dielectric body 102 to provide impedance matching between the connector 100' and the coaxial cable 125, the impedance of which may be 50 ohms, to provide enhanced signal transmission. Indeed, in some embodiments only a single impedance matching notch may be used. Impedance mismatches typically result in a partial reflection of the signal, which not only increase signal loss through the connector, but also can result in a signal propagation delay.

Figure 5:
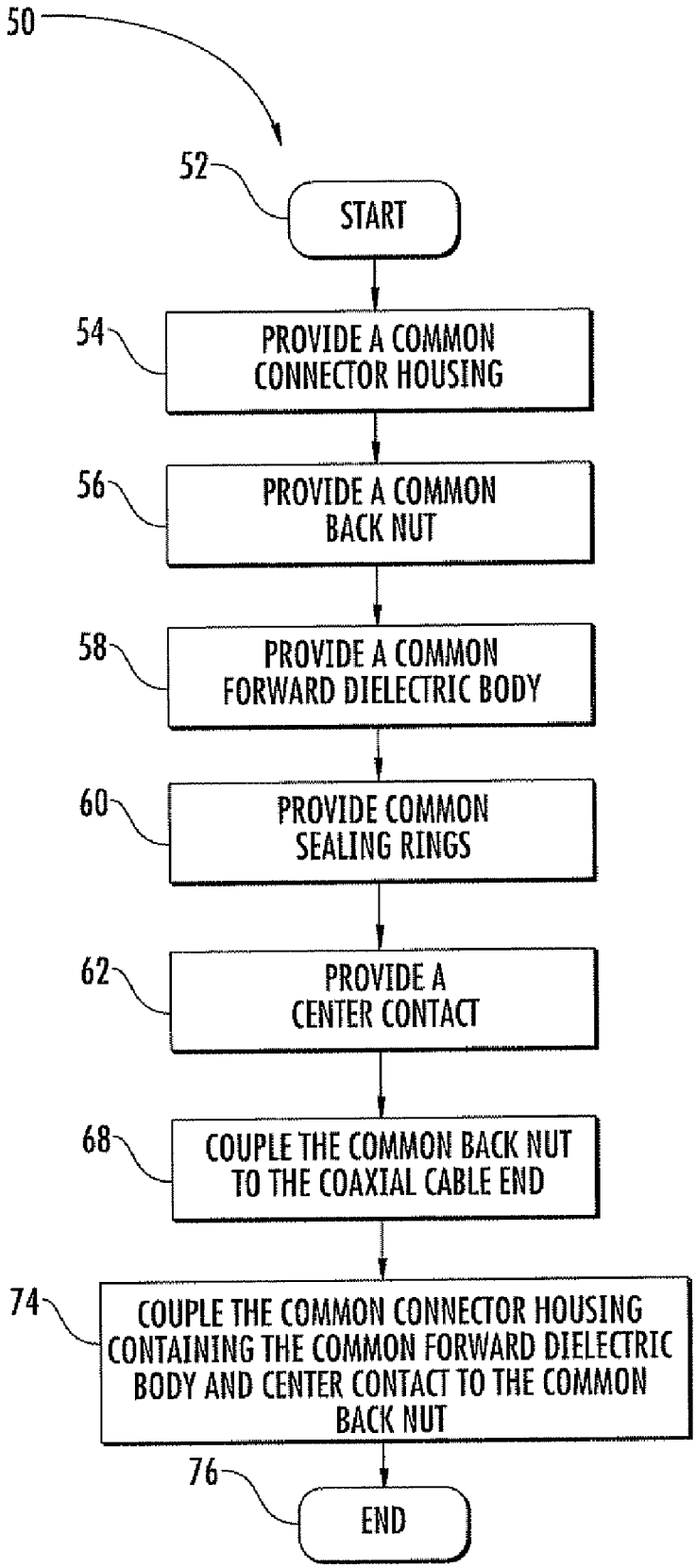
FIG. 5 is a flow chart illustrating a method for assembling a coaxial cable connector onto a coaxial cable end in a field installable configuration in accordance with the present invention.

In other aspects, as illustrated additionally in FIG. 5, for example, a method for field installation of a coaxial cable connector 100 onto a coaxial cable end 125 is described, with reference to the flowchart 50. More particularly, the method after the start (Block 52) includes providing a set of the common connector components, including a common connector housing 101 (Block 54), a common back nut 116 (Block 56), a common forward dielectric body 102 (Block 58), and optional common sealing rings 127 (Block 60), along with a center contact 108 (Block 62).

The cable end 125 is prepared for the coaxial cable connector 100, as will be appreciated by those skilled in the art. The common connector components are then assembled to the end of the coaxial cable 125. The common back nut 116 is coupled to the coaxial cable end 125 (Block 68). The common connector housing 101 containing the common forward dielectric body 102 is also coupled to the common back nut 116 (Block 74), before ending at Block 76.

Figure 6:
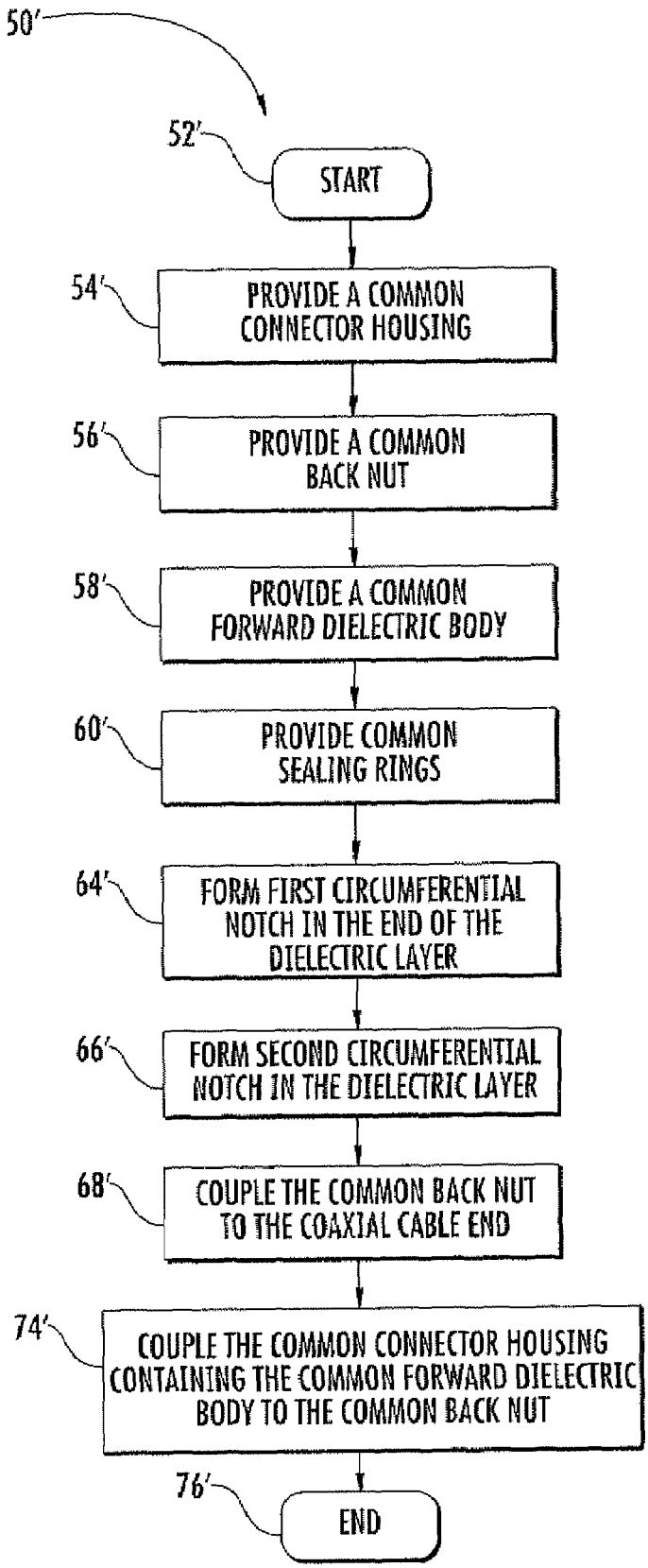
FIG. 6 is another flow chart illustrating a method for assembling a coaxial cable connector onto a coaxial cable end in a factory installable configuration in accordance with the present invention.

Referring now to FIG. 6, a method for factory installation of a coaxial cable connector 100' onto a coaxial cable end 125 is described with reference to the flowchart 50'. More particularly, the method after the start (Block 52') includes providing a set of the common connector components, including a common connector housing 101 (Block 54'), a common back nut 116 (Block 56'), a common forward dielectric body 102 (Block 58'), and optional common sealing rings 127 (Block 60'). No center contact 108 is provided.

Part of the cable end 125 preparation includes formation of at least one impedance matching circumferential notch 131, 133. Preferably, first and second impedance matching circumferential notches 131, 133 are formed in the dielectric layer of the coaxial cable 107 at Blocks 64' and 66', respectively. The first impedance matching circumferential notch 131 is formed at the end of dielectric layer 107. The second impedance matching circumferential notch 132 is formed upstream, longitudinally spaced from the first notch 131 and adjacent an inner circumferential notch 133 in the common connector housing 101.

The common connector components are then assembled to the end of the coaxial cable 125. The common back nut 116 is coupled to the coaxial cable end 125 (Block 68'). The common connector housing 101 containing the common forward dielectric body 102 is also coupled to the common back nut 116 (Block 74'), before ending at Block 76'.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for making coaxial cable connector components for assembly into either first or second different connector configurations, the method comprising:

forming a plurality of center contacts for the first connector configuration; and forming a plurality of common connector components for either the first or second connector configuration and comprising a plurality of common connector housings, a plurality of common back nuts, each for clamping an outer conductor of a coaxial cable in cooperation with a respective common connector housing, and a plurality of common forward dielectric bodies, each having a passageway therethrough, and for supporting a respective center contact for the first connector configuration, and for alternatively supporting a respective forward portion of an inner conductor of a coaxial cable for the second configuration, the plurality of common forward dielectric bodies providing impedance matching with a coaxial cable for both the first and second connector configurations.

2. A method according to claim 1 wherein forming each common forward dielectric body comprises forming a cylindrical dielectric body having a sidewall with a plurality of hollow cavities to set an impedance.

3. A method according to claim 2 wherein each of the plurality of hollow cavities extends only partway into the sidewall; and wherein each of the plurality of hollow cavities has a cylindrical shape.

4. A method according to claim 2 wherein each of the common forward dielectric bodies has a longitudinal axis; and wherein each of the plurality of hollow cavities comprises an elongate hollow cavity extending generally parallel with the longitudinal axis of each common forward dielectric body; and wherein the plurality of hollow cavities is equally angularly spaced about the longitudinal axis of each common forward dielectric body.

5. A method according to claim 1 further comprising forming a plurality of rearward dielectric bodies also for the first connector configuration, each having a passageway therethrough for supporting a respective rearward portion of the inner conductor of the coaxial cable.

6. A method according to claim 1 wherein the first connector configuration comprises a field installable connector configuration.

7. A method according to claim 1 wherein the second connector configuration comprises a factory installable connector configuration.

8. A method according to claim 1 further comprising packaging the connector components in respective first and second packages for assembly into the first and second connector configurations.

9. A method according to claim 1 wherein forming each common connector housing comprises forming a monolithic tubular metallic body having threads on a rearward surface thereof.

10. A method according to claim 1 wherein forming each common back nut comprises forming a monolithic tubular body having threads on a portion thereof.

11. A method according to claim 1 wherein forming the plurality of common connector components further comprises forming a plurality of common sealing rings.

12. A method for making coaxial cable connector components for assembly into either field installable or factory installable connector configurations, the method comprising:

forming a plurality of center contacts for the field installable connector configuration;

forming a plurality of common connector components for either connector configuration and comprising a plurality of common connector housings, a plurality of common back nuts, each for clamping an outer conductor of a coaxial cable in cooperation with a respective common connector housing, and a plurality of common forward dielectric bodies, each having a passageway therethrough, and for supporting a respective center contact for the field installable configuration, and for alternatively supporting a respective forward portion of an inner conductor of a coaxial cable for the factory installable configuration, the plurality of common forward dielectric bodies providing impedance matching with a coaxial cable for both field installable and factory installable connector configurations; and packaging the connector components in respective field installable and factory installable connector configurations packages.

13. A method according to claim 12 wherein forming each common forward dielectric body comprises forming a cylindrical dielectric body having a sidewall with a plurality of hollow cavities to set an impedance.

14. A method according to claim 13 wherein each of the plurality of hollow cavities extends only partway into the sidewall; and wherein each of the plurality of hollow cavities has a cylindrical shape.

15. A method according to claim 13 wherein each of the common forward dielectric bodies has a longitudinal axis; and wherein each of the plurality of hollow cavities comprises an elongate hollow cavity extending generally parallel with the longitudinal axis of each common forward dielectric body; and wherein the plurality of hollow cavities is equally angularly spaced about the longitudinal axis of each common forward dielectric body.

16. A method according to claim 12 further comprising forming a plurality of rearward dielectric bodies also for the field configuration, each having a passageway therethrough for supporting a respective rearward portion of the inner conductor of the coaxial cable.

17. A method according to claim 12 wherein forming the plurality of common connector components further comprises forming a plurality of common sealing rings.

18. A method for field installation of a coaxial cable connector onto a coaxial cable end, the method comprising:

providing a center contact;

providing a set of common connector components for either a field installable connector configuration, or alternatively for a factory installable connector configuration, the set of common connector components comprising a common connector housing, a common back nut for clamping an outer conductor of the coaxial cable in cooperation with the common connector housing, and a common forward dielectric body having a passageway therethrough and for supporting the center contact for the field installable configuration, and for alternatively supporting a respective forward portion of the inner conductor of the coaxial cable for the factory installable configuration, the common forward dielectric body providing impedance matching with the coaxial cable for both field installable and factory installable connector configurations; and assembling the set of common connector components and the center contact onto the coaxial cable end.

19. A method according to claim 18 wherein assembling the set of common components comprises coupling the common back nut to the coaxial cable end, and coupling the common connector housing containing the common forward dielectric body and center contact to the common back nut.

20. A method for factory installation of a coaxial cable connector onto a coaxial cable end, the method comprising:

providing a set of common connector components for either a field installable connector configuration, or alternatively for a factory installable connector configuration, the set of common connector components comprising a common connector housing, a common back nut for clamping an outer conductor of the coaxial cable in cooperation with the common connector housing, and a common forward dielectric body having a passageway therethrough and for supporting a respective forward portion of the inner conductor of the coaxial cable for the factory installable configuration, and for alternatively supporting a center contact for the field installable configuration, the common forward dielectric body providing impedance matching with the coaxial cable for both field installable and factory installable connector configurations; and assembling the set of common connector components to the coaxial cable end.

21. A method according to claim 20 further comprising forming at least one impedance matching circumferential notch in a dielectric layer of the coaxial cable to be received within the common connector housing for impedance matching.

22. A method according to claim 21 wherein forming the at least one impedance matching circumferential notch comprises forming a first circumferential notch at an end of the dielectric layer, and a second circumferential notch longitudinally spaced from the first circumferential notch.

23. A method according to claim 20 wherein assembling the set of common connector components comprises coupling the common back nut to the coaxial cable end, and coupling the common connector housing containing the common forward dielectric body to the common back nut.

24. A coaxial cable connector assembly comprising:

a coaxial cable end comprising an inner conductor, an outer conductor, and a dielectric layer therebetween;

a housing;

a forward dielectric body carried by said housing and having a cylindrical shape, said forward dielectric body comprising a sidewall defining a passageway therethrough receiving the inner conductor and said sidewall having at least one hollow cavity therein to set an impedance;

a back nut clamping the outer conductor in cooperation with said housing; and said dielectric layer having at least one impedance matching circumferential notch therein for providing impedance matching with said coaxial cable end.

25. A coaxial cable connector assembly according to claim 24 wherein said at least one impedance matching circumferential notch comprises a first circumferential notch at an end of the dielectric layer, and a second circumferential notch longitudinally spaced from said first circumferential notch.

26. A coaxial cable connector assembly according to claim 25 wherein said housing comprises an inner circumferential notch adjacent said second circumferential notch.

27. A coaxial cable connector assembly according to claim 24 wherein the at least one hollow cavity extends only partway into the sidewall; and wherein the at least one hollow cavity has a cylindrical shape.

28. A coaxial cable connector assembly according to claim 24 wherein said forward dielectric body has a longitudinal axis; and wherein the at least one hollow cavity comprises an elongate hollow cavity extending generally parallel with the longitudinal axis of said forward dielectric body; and wherein the at least one hollow cavity is equally angularly spaced about the longitudinal axis of said forward dielectric body.

29. A coaxial cable connector assembly according to claim 24 wherein said back nut comprises a monolithic tubular body having threads on a portion thereof.

30. A coaxial cable connector assembly according to claim 24 further comprising at least one sealing ring carried by said housing.

* * * * *